US005492043A

United States Patent [19]

Badillo

[11] Patent Number: 5,492,043

[45] Date of Patent: Feb. 20, 1996

[54] COMPONENT CUTTING BLOCK AND HOLDER FOR STATIONARY SURGER BLADE

[76] Inventor: Paul Badillo, 7644 Dawn Dr., Littleton, Colo. 80125

[21] Appl. No.: 182,784

[22] Filed: Jan. 13, 1994

[51] Int. Cl.[6] ..... B26D 1/02

[52] U.S. Cl. ..... 83/698.11; 83/856

[58] Field of Search ..... 83/698.11, 856; 70/339; 112/129, 130, 122

[56] References Cited

U.S. PATENT DOCUMENTS

| | | | |
|---|---|---|---|
| 323,439 | 8/1885 | Ober | 112/129 |
| 1,296,455 | 3/1919 | Berger | 112/129 |
| 1,726,017 | 8/1929 | Des Enfants, Sr. | 30/339 |
| 2,432,345 | 12/1947 | Sloman | 30/339 |
| 3,047,946 | 8/1962 | Lins | 30/339 |
| 4,227,306 | 10/1980 | Msehulam | 30/339 |
| 4,781,131 | 11/1988 | Fenzi | 112/130 |
| 5,056,226 | 10/1991 | Gringer | 30/339 |

FOREIGN PATENT DOCUMENTS

| | | | |
|---|---|---|---|
| 885747 | 6/1943 | France | 30/339 |
| 29596 | 1/1914 | United Kingdom | 30/339 |

*Primary Examiner*—Kenneth E. Peterson
*Attorney, Agent, or Firm*—Sheridan Ross & McIntosh

[57] ABSTRACT

A stationary cutting blade having a separately formed blade holder and cutting edge which can be replaced as individual components. The cutting edge is formed of premium wear materials such as ceramic or carbide and the holder is stamped from a rigid metal. The cutting blade is a lamninated piece comprising two outer layers which form the blade holder, with the cutting edge in the middle layer. The blade reduces manufacturing costs of using premium wear materials and also eliminates the need for sharpening.

5 Claims, 3 Drawing Sheets

COMPONENT CUTTING BLOCK AND HOLDER FOR STATIONARY SURGER BLADE

FIELD OF THE INVENTION

The present invention relates to a stationary cutting blade for overlock sewing equipment for use with a cooperating moving blade to cut the excess fabric from a surged seam. In particular the invention relates to a new method of manufacturing and utilizing a stationary surger blade.

BACKGROUND OF THE INVENTION

Surger blades are among the most replaced parts in the industrial sewing industry. The sewing speeds of today's overlock sewing equipment (also referred to as surgers) can reach up to 9500 stitches per minute. At these speeds both moving and stationary blades are susceptible to high tempertures, varying pressure between the blades, and chipping, leading to quick dulling of the blades. When these conditions occur, the fabric docs not cut cleanly. The blade must be continually sharpened. Often the blade must be sharpened every few days.

The use of high wear materials has greatly reduced the wear rates in surger blades. Carbide is the primary material used for those who seek better wearing blades. Presently the carbide is brazed onto the cutting end of the surger blade so as to reduce the amount of carbide material used. The expensive carbide material and the high cost of attaching the carbide to the steel fixture makes it difficult for many to afford to purchase these parts. Similarly, the use of ceramic as a cutting edge has the same drawbacks as carbide in that it is too expensive for many markets to purchase.

Horst Fenzi, U.S. Pat. No. 4,781,131, recognized the need for reducing the costs associated with surger blade wear. In his patent, he shows a multi-sided cutting blade which could be engaged in a blade holder in a plurality of positions corresponding to the multi-sided cutting edges. By loosening the mounting screw, he could rotate the blade to an unused cutting edge and therefore quickly eliminate downtime due to blade resharpening or blade replacement. Fenzi's teachings however, actually lead away from the teachings of the present invention because it specifically applies to an upper moving blade. The upper moving blade allows and in fact requires a thick mass at the area where Fenzi has his screw attaching means. This mass is required because as the leading edge of the moving upper blade moves past the cutting edge of the stationary blade, it must have enough mass to prevent breakage due to the high pressure of the opposing blade. Fenzi correctly designed the screw mounting means to be on the outside of the cutting edge, away from the opposing lower knife cutting edge. The lower stationary blade however, must remain thin to allow maximum adjustability relative to the needle and therefore allow for differing edge dimensions on the fabric being sewn. The mass that is required to utilize a screw mounting means is insufficient for a stationary lower blade and would cause cracking and breakage.

SUMMARY OF THE INVENTION

The present invention comprises a cutting block formed of premium wearing material such as carbide or ceramic. The cutting block is a flat piece consisting of opposing interior and exterior faces. The corresponding vertical edges are parallel. The cutting edge is the upper edge which angles generally upward according to the specifications of the specific sewing machine. The cutting block should have alignment holes or the like to prevent movement in any direction.

The present invention further comprises a support base that abuts against the outer face of the cutting block. Alignment studs are provided to engage with the alignment holes of the cutting block. The support base should be made of a spring steel or the like in order to remain a rigid support for the cutting block.

The present invention further comprises a support cover which abuts the inner face of the cutting block. This support cover could be a separate piece from the support base or preferably it could be part of the support base when folded to pivot upwards to cover the inner face of the cutting block. The support cover should taper away from the leading edge of the moving knife to avoid the possibility of fabric being wedged between the support cover and cutting block.

A knife holding clamp is screwed into a solid fixture and applies sufficient pressure to the support cover to hold the cutting block firmly in place.

The cutting block of this invention is pressed, stamped or molded. The amount of expensive premium material is substantially reduced because the cutting block constitutes a small fraction of the entire blade. The relatively small cutting block can be ground at a greatly reduced cost because many more parts can be placed on grinding fixtures for mass production. The support base and the support cover are preferably stamped complete with alignment studs. Because of the novel mounting means, the use of the knife holding clamp- a generic part of every surger sewing machine—can be easily applied without modification from the manufacturer.

Accordingly, several objects and advantages of my invention are: to provide a stationary lower blade that is not meant to be sharpened. A further object is to provide a new method of manufacturing that allows the use of premium materials for cutting edges, at greatly reduced manufacturing costs. A further object is to provide a component blade assembly whereby the parts can be replaced individually as needed. Another object is to provide a cutting edge formed of a premium cutting surface for best quality cutting performance and longest wearability. Further objects and advantages of my invention will become apparent from a consideration of the drawings and ensuing description of it.

DETAILED DESCRIPTION OF REFERRED EMBODIMENTS

Figure 1:
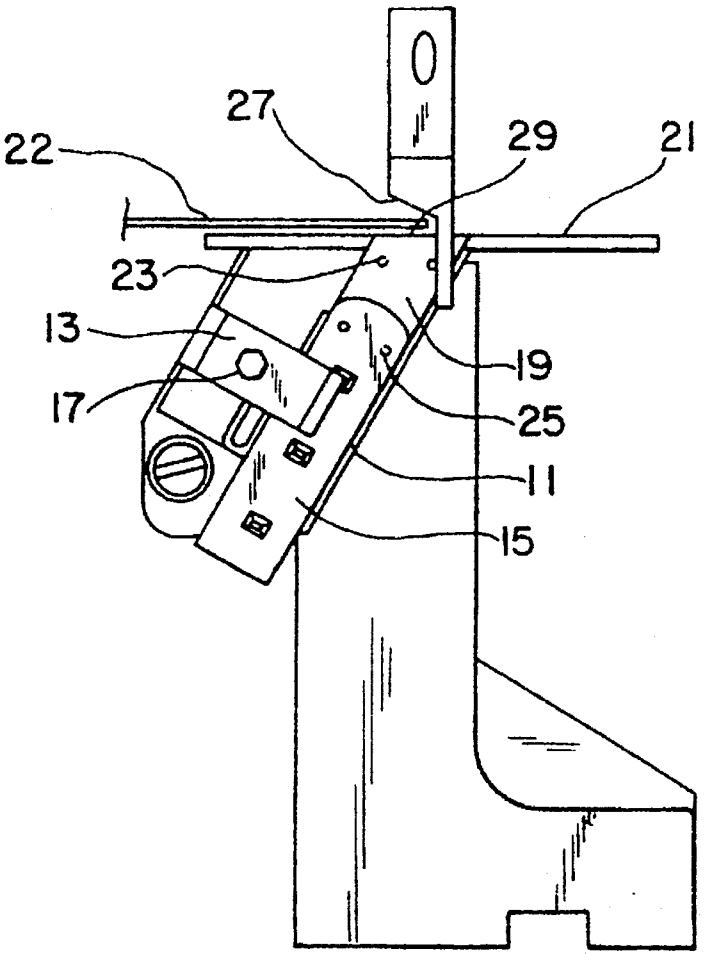
FIG. 1 shows a side view of the invention mounted in its operational environment.

FIG. 1 shows a side view of the invention while mounted in its operational environment. The present invention is secured to a knife holding track 11. Knife holding clamp 13 provides pressure on a support cover 15. A knife holding clamp screw 17 regulates the securing pressure. Cutting block 19 aligns evenly with throat plate 21 thus allowing fabric 22 to pass unrestricted. A plurality of alignment holes 23 are shown on the face of cutting block 19. A plurality of alignment studs 25 are pressed into support cover 15. The leading edge of an upper blade 27 passes a cutting edge 29 on cutting block 19 as fabric 22 is sewn. Support cover 15 must taper at its upper end to avoid fabric getting caught between it and cutting block 19.

Figure 2:
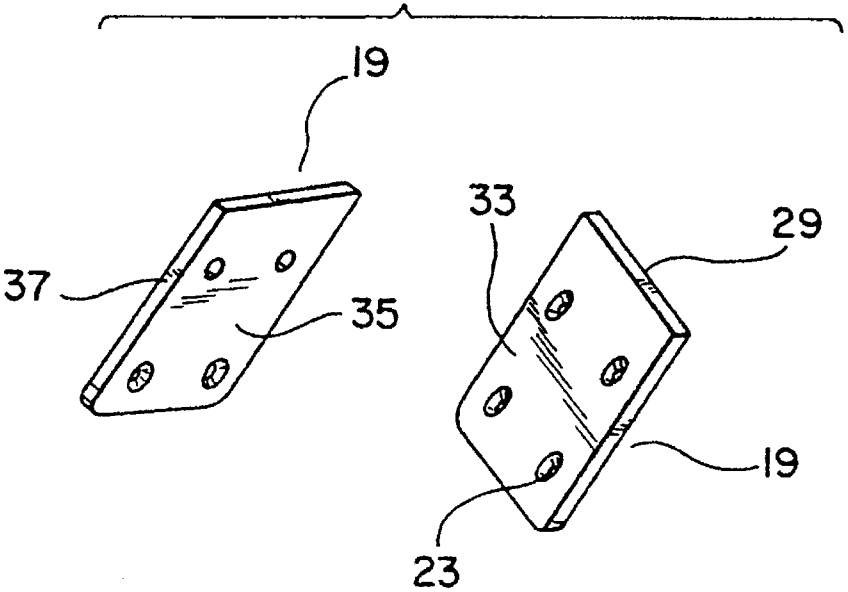
FIG. 2 shows two perspective views of the cutting block of the present invention

FIG. 2 shows two perspective views of cutting block 19. An inner face 33 and outer face 35 are carried by an edge 37. Cutting edge 29 is angled according to specific specifications of the sewing machine. Alignment holes 23 are shown.

Figure 3:
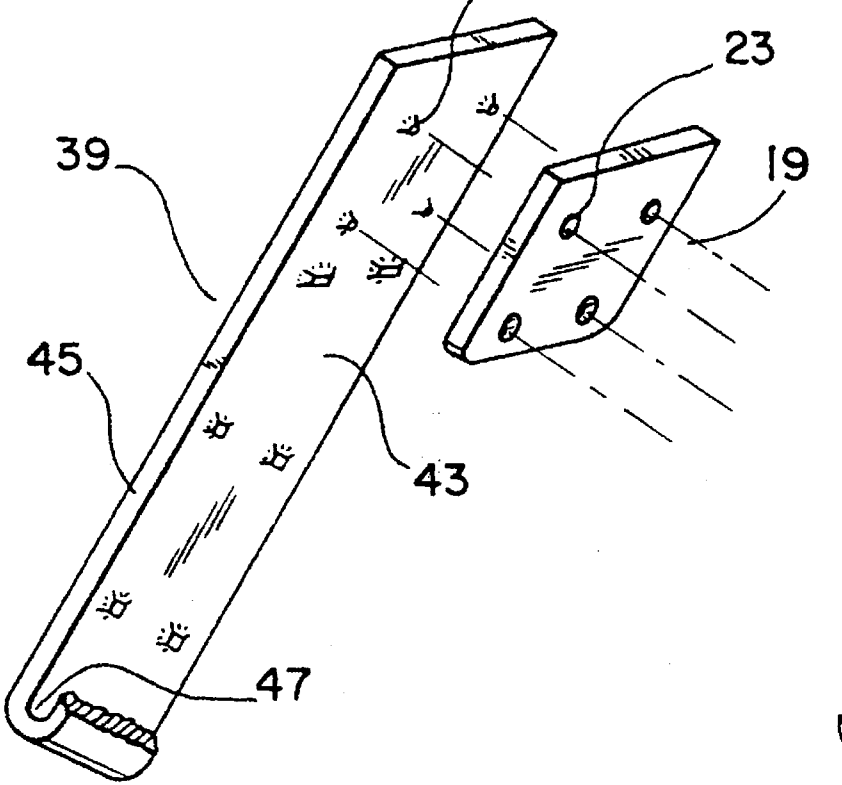
FIG. 3 shows a cutaway perspective view of cutting block and the support base and their alignment thereof according to the preferred embodiment of the present invention.

FIG. 3 shows a cutaway perspective view of cutting block and the support base and their alignment thereof according to the preferred embodiment of the present invention. Cutting block 19 aligns with a support base 39. A plurality of alignment studs 41 engage the alignment holes 23 of cutting block 19. Support base 39 has an inner face 43 carried by a support base edge 45. The width of inner face 43 is approximately equal with the width of cutting block 19. In the preferred embodiment support base 39 folds upward at bend 47 and merges into support cover 15.

Figure 4:
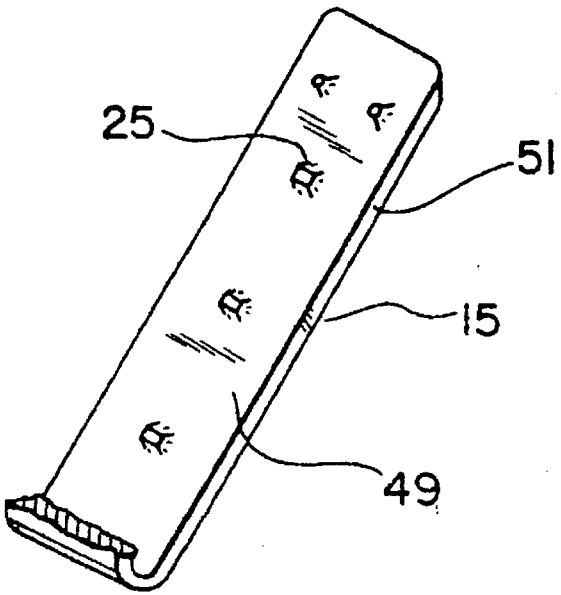
FIG. 4 shows a cutaway perspective view of the preferred embodiment of the support cover of this invention.

FIG. 4 shows a cutaway perspective view of the preferred embodiment of support cover 15 of this invention. Inner wall 49 has a plurality of inwardly stamped alignment studs 25. Edge 51 is carried by an inner face 49 and its opposing outer face (not shown). The width of support cover 15 is approximately the same width as support base 39 and cutting block 19.

Figure 5:
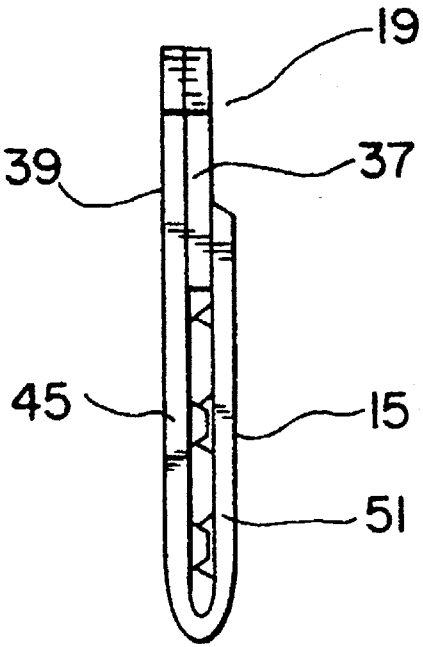
FIG. 5 shows a side view of the present invention.

FIG. 5 shows a side view of the present invention. In the preferred embodiment edge 45 of support base 39 merges into edge 51 of support cover 15. Edge 37 of cutting block 19 extends for a minor portion of the length that it faces support cover 15. A plurality of stamped alignment studs 25 and 41 prevent cutting block 19 from moving.

Figure 6:
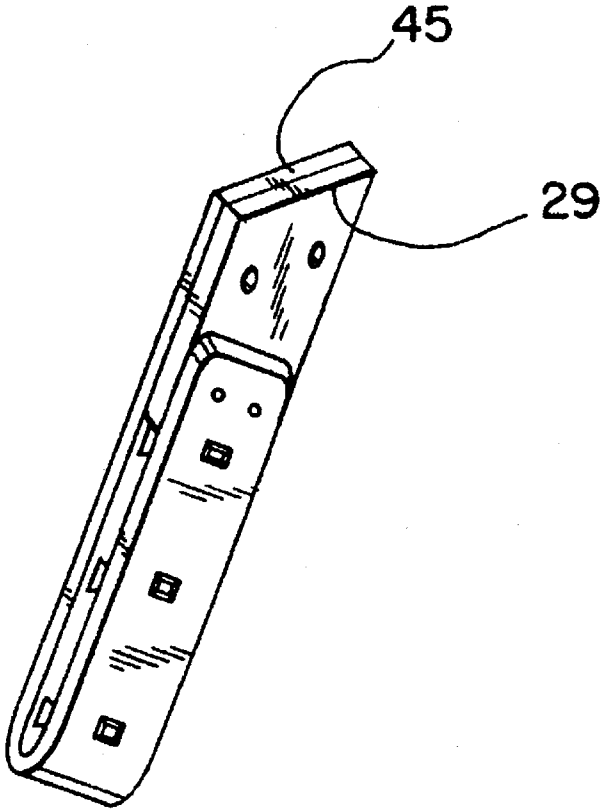
FIG. 6 shows a perspective view of the preferred embodiment of this invention.

FIG. 6 shows a perspective view of the preferred embodiment of this invention. It is preferred that cutting edge 29 stays even with support base edge 45. Support base edge 45 should never extend beyond cutting edge 29.

CONCLUSION, RAMIFICATIONS, AND SCOPE OF INVENTION

Thus the reader will see that the invention can be made with minimum amount of labor, and allows the user to utilize a premium wear surface, and still eliminate sharpening. The reusable holder is designed to accommodate additional cutting blocks when worn.

I claim:

1. A surger blade assembly for a sewing machine comprising a throat plate, a slot, and a reciprocating knife which passes through the slot to cut a stitchable material in cooperation with said surger blade assembly, said surger blade assembly being attachable to the sewing machine in a stationary position and comprising:

a surger blade holder comprising first and second displaced members, said first and second members each comprising an upper edge, wherein at least a portion of said upper edge of said first member extends beyond said upper edge of said second member a predetermined distance and is in substantial proximity with the throat plate, wherein at least a portion of said upper edge of said second member in vertical alignment with the reciprocating knife is disposed below the throat plate, wherein said first member further comprises first and secondly substantially parallel side edges which define a width of said first member and said upper edge of said first member extends between and is disposed at an acute angle relative to one of said first and second edges of said first member and at an obtuse angle relative to the other of said first and second edges of said first member;

a surger blade positioned between said first and second members and comprising a top surface with a cutting edge and first and second substantially parallel side edges which extend downwardly away from said cutting edge and define a width of said surger blade, said cutting edge of said surger blade being disposed at an acute angle relative to one of said first and second side edges of said surger blade and at an obtuse angle relative to the other said first and second side edges of said surger blade; and a surger blade retainer assembly, wherein said surger blade is securably retained between said first and second members with said cutting edge being positionable in proximity with the throat plate, wherein said first member supports a substantial portion of said surger blade interfacing with the reciprocating knife when passing through the slot and said second member supports a lower portion of said surger blade to allow for unrestricted reciprocation by the reciprocating knife.

2. A surger blade assembly as claimed in claim 1, wherein:

said surger blade holder is a substantially U-shaped member, wherein said first and second members of said surger blade holder are interconnected by a U-shaped element.

3. A surger blade assembly as claimed in claim 2, wherein:

said first and second members are integrally formed with said U-shaped element.

4. A surger blade assembly as claimed in claim 2, wherein:

said surger blade retainer assembly comprises at least one slot associated with one of said surger blade and said surger blade holder and at least one post receivable within said slot, said post being associated with the other of said surger blade and said surger blade holder.

5. A surger blade assembly as claimed in claim 1, wherein:

said surger blade holder comprises a metal and said surger blade is formed from a material selected from the group consisting of essentially ceramic and carbide.

* * * * *